US009213286B1

(12) United States Patent
Ogasawara

(10) Patent No.: US 9,213,286 B1
(45) Date of Patent: Dec. 15, 2015

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masato Ogasawara, Tokyo-to (JP)

(73) Assignees: Kabushiki Kaisha Toshiba, Tokyo (JP); Toshiba Tec Kabushiki Kiasha, Tokyo (JP)

( * ) Notice: Subject to any disclaimer, the term of this patent is extended or adjusted under 35 U.S.C. 154(b) by 0 days.

(21) Appl. No.: 14/319,500

(22) Filed: Jun. 30, 2014

(51) Int. Cl.
*G03G 15/00* (2006.01)
*G03G 21/00* (2006.01)
*G03G 15/01* (2006.01)

(52) U.S. Cl.
CPC ..... *G03G 15/50* (2013.01); *G03G 15/01* (2013.01); *G03G 2215/00789* (2013.01)

(58) Field of Classification Search
CPC ..... G03G 15/6582; G03G 15/6585; G03G 2215/00789; G03G 2215/00797; G03G 15/50; G03G 15/01
USPC ..... 399/1, 2, 12, 38, 411
See application file for complete search history.

(56) References Cited

U.S. PATENT DOCUMENTS

| | | | | |
|---|---|---|---|---|
| 2009/0154970 | A1* | 6/2009 | Yoshida et al. | 399/341 |
| 2010/0272449 | A1* | 10/2010 | Yoshida et al. | 399/2 |
| 2013/0011149 | A1 | 1/2013 | Ogasawara et al. | |
| 2013/0236196 | A1* | 9/2013 | Shinohara | 399/12 |

* cited by examiner

*Primary Examiner* — Sophia S Chen
(74) *Attorney, Agent, or Firm* — Amin, Turocy & Watson, LLP

(57) ABSTRACT

In accordance with one embodiment, an image forming apparatus with a first printing device configured to carry out printing with a non-decolorable recording material, second printing device configured to carry out printing with a decolorable recording material, the color of which is same or same color system of the color of the non-decolorable recording material; and an identification mark adding section configured to add, to a record receiving member printed by at least one of the first printing device and the second printing device, an identification mark indicating which one of the first and second printing devices is used for printing.

10 Claims, 7 Drawing Sheets

IMAGE FORMING APPARATUS AND IMAGE FORMING METHOD

FIELD

Embodiments described herein relate to an image forming apparatus and an image forming method.

BACKGROUND

In order to recycle paper, there is a method of forming an image on the paper with decolorable toner. The decolorable toner generates color in image forming process, and is erased when the toner is heated and the color material in the toner loses its color. If the printing which is not required to be recorded permanently is carried out on paper with the decolorable toner, the paper subjected to printing processing, reading processing and then color erasing processing can be reused, which can save paper resource.

Generally, the development (printing) based on the decolorable toner is carried out with ink of a color (for example, blue) different from black color, so as to distinguish the development from the printing based on non-decolorable toner. However, as printing object is generally printed with black color, the document printed with blue color and the like may cause a sense of discomfort (for example, hard to read) to a reader.

However, if the printing based on the decolorable toner is carried out using black toner, it is difficult to distinguish the printing based on the decolorable toner from the printing based on the non-decolorable toner in a case of a color printing as well as a case of a monochrome printing.

Thus, the present invention provides an image forming apparatus which can easily identify whether the printing is carried out with non-decolorable toner or decolorable toner.

DETAILED DESCRIPTION

In accordance with one embodiment, an image forming apparatus comprises at least one of a non-decolorable recording material printing device configured to carry out printing with a non-decolorable recording material and a decolorable recording material printing device configured to carry out printing with a decolorable recording material of a color of the same system with the non-decolorable recording material, and an identification mark adding section configured to add, to a record receiving member printed by at least one of the non-decolorable recording material printing device and the decolorable recording material printing device, a visible identification mark for indicating that printing is carried out with non-decolorable recording material or decolorable recording material using a color of the same system with the printing or the same recording material.

In this embodiment, 'decoloring' means to make it difficult to recognize a color of an image formed on an image receiving member after the image is formed on the image receiving member by an recording material which has different color from the color of the image receiving material. The color of recording material may be a chromatic color including black or white, not limiting to chromatic color. And in the following embodiment, 'decoloring the image' means 'erasing the image'.

Embodiments are described below with reference to the accompanying drawings. The constitution of the entire system according to one embodiment is shown in FIG. 1.

The embodiment is about an image forming apparatus capable of carrying out full color image formation with non-decolorable or inerasable toner, black image formation with non-decolorable black toner and image formation with decolorable black toner.

Herein, the visualization of a latent image based toner is included in the development, and the visualization based on other inkjet manner and the like, including the visualization mentioned above, is referred to as printing, or as image formation as a broader concept.

Figure 1:
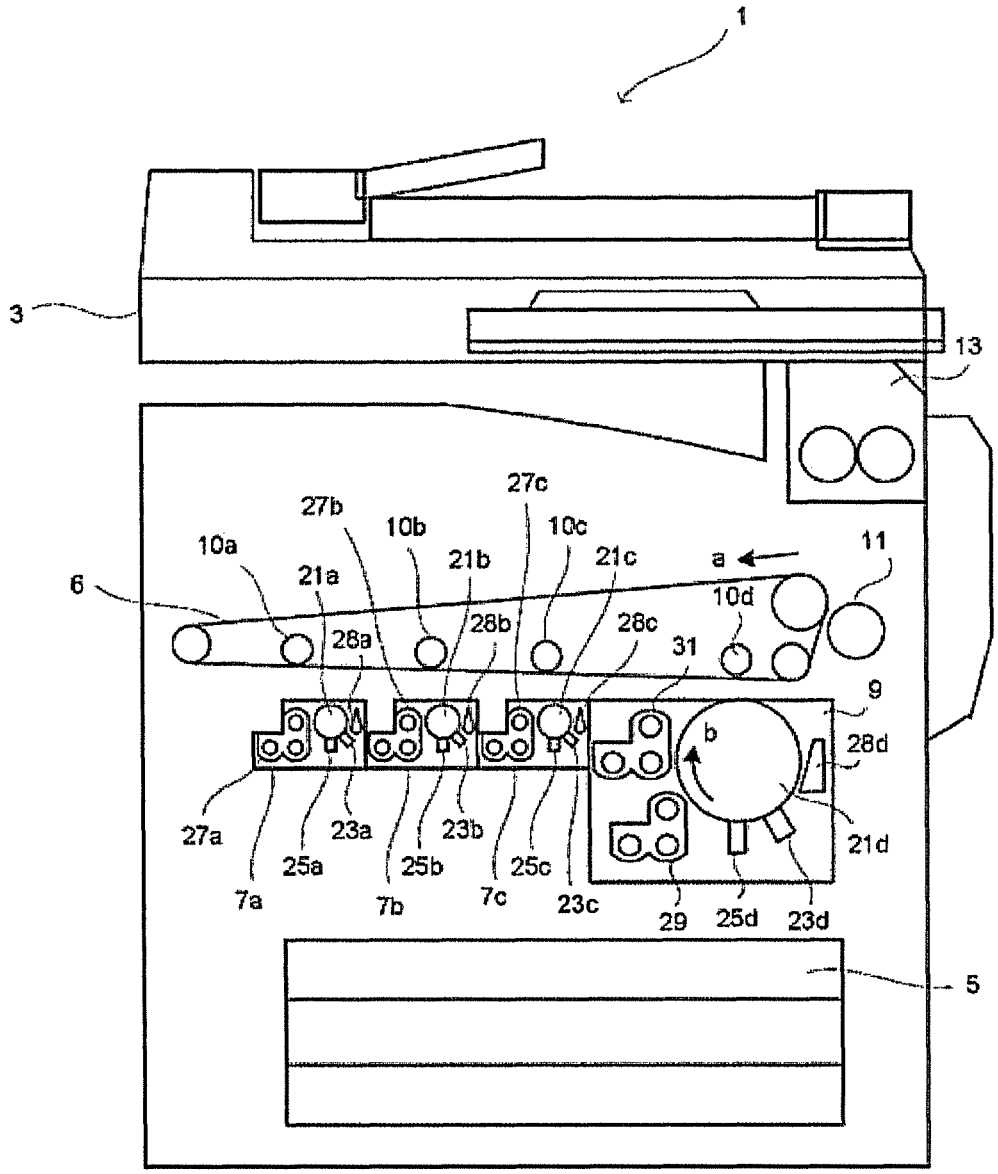
FIG. 1 is a schematic section view of an image forming apparatus according to a first embodiment.

FIG. 1 is an exemplary schematic constitution diagram of the image forming apparatus according to the first embodiment. A MFP 1 is an image forming apparatus using a quadruple tandem process. The MFP 1 is provided with a scanner 3 at the upper portion thereof for scanning a document and a paper feed cassette 5 at the lower portion thereof for storing paper. The MFP 1 further includes, between the scanner 3 and the paper feed cassette 5, an intermediate transfer belt 6 capable of moving in the direction indicated by an arrow a shown in FIG. 1 and four image forming sections, that is, a yellow image forming section 7*a*, a magenta image forming section 7*b*, a cyan image forming section 7*c* and a black image forming section 9, arranged around the intermediate transfer belt 6.

The yellow image forming section 7*a*, the magenta image forming section 7*b* and the cyan image forming section 7*c* constitute a first image forming section, and the black image forming section 9 constitutes a second image forming section. The yellow image forming section 7*a*, the magenta image forming section 7*b* and the cyan image forming section 7*c* form an image with non-decolorable yellow toner (hereinafter, referred to as Y toner), magenta toner (hereinafter, referred to as M toner), cyan toner (hereinafter, referred to as C toner), respectively.

The black image forming section 9 comprises, as stated later, an decolorable black toner developing device 29 for developing an image with decolorable black toner (EBK toner) and a non-decolorable black toner developing device 31 for developing an image with non-decolorable black toner (NBK toner).

Transfer rollers 10*a*, 10*b*, 10*c* and 10*d* are arranged opposite to the yellow image forming section 7*a*, the magenta image forming section 7*b*, the cyan image forming section 7*c* and the black image forming section 9 across the intermediate transfer belt 6.

A secondary transfer roller 11 is arranged at the downstream side of the black image forming section 9 along the moving direction of the intermediate transfer belt 6 to transfer the toner image formed on the intermediate transfer belt 6 by the image forming sections 7*a*, 7*b*, 7*c* and 9 to the paper fed from the paper feed cassette 5. A fixing device 13 is arranged at the downstream side of the secondary transfer roller 11 along the conveyance direction of the paper fed from the paper feed cassette to fix the toner image on the paper.

The constitutions of the yellow image forming section 7*a*, the magenta image forming section 7*b* and the cyan image forming section 7*c* are the same except for the toner stored inside, therefore, the constitutions of the yellow image forming section 7*a*, the magenta image forming section 7*b* and the cyan image forming section 7*c* are described by taking the yellow image forming section 7*a* as an example.

The yellow image forming section 7*a* is provided with a photoconductive drum 21*a*. A charger 23*a* for uniformly charging the photoconductive drum 21*a*, a LED type exposure device 25*a* for selectively exposing the charged photoconductive drum 21*a* according to image information and a developing device 27*a* for storing non-decolorable yellow toner and developing the electrostatic latent image formed by the exposure device 25*a* corresponding to yellow color are arranged around the photoconductive drum 21*a*. The yellow image forming section 7*a* further comprises a cleaning device 28*a* for removing the toner left on the photoconductive drum 21*a* after the toner image on the photoconductive drum 21*a* is transferred by the transfer roller 10*a*.

Similarly, the magenta image forming section 7*b* and the cyan image forming section 7*c* comprise photoconductive drums 21*b* and 21*c*, chargers 23*b* and 23*c*, exposure devices 25*b* and 25*c*, developing devices 27*b* and 27*c*, cleaning devices 28*b* and 28*c*, respectively. However, the toner stored in the developing device 27*b* is non-decolorable magenta toner, and the toner stored in the developing device 27*c* is non-decolorable cyan toner. The developing devices 27*a*, 27*b* and 27*c* are collectively referred to as YMC developing devices in the following description.

The image forming section 9 comprises a photoconductive drum 21*d* which rotates in the direction indicated by an arrow b shown in FIG. 1. A charger 23*d* for charging the photoconductive drum 21*d* and a LED type exposure device 25*d* for selectively exposing the charged photoconductive drum 21*d* according to image information are arranged around the photoconductive drum 21*d*.

The exposure mentioned above refers to exposure in which a message indicating, for example, in a case of an image formation with decolorable toner, that the image is formed with decolorable toner is added as a notice to the part corresponding to normal image information.

Further, a developing device 29 and a developing device 31 are arranged opposite to the photoconductive drum 21*d* at the downstream side of the exposure device 25*d* along the rotation direction of the photoconductive drum 21*d*. The decolorable black toner developing device 29 stores the decolorable black toner EBK, and the non-decolorable black toner developing device 31 stores the non-decolorable black toner NBK.

The developing device 29 and the developing device 31 are selectively used to develop an image (image formation) on the photoconductive drum 21*d*. The black image forming section 9 further comprises a cleaning device 28*d* for removing the toner left on the photoconductive drum 21*d* after the toner image formed by the decolorable black toner developing device 29 or the non-decolorable black toner developing device 31 is transferred on the intermediate transfer belt 6 by the transfer roller 10*d*.

The decolorable black toner EBK stored in the decolorable black toner developing device 29 is capable of conducting a reversible color generation/erasing reaction, that is, the toner is color-erased when heated to a temperature above a given temperature, and generates color if the temperature is lowered to below a given recoloring temperature.

No specific limitation is given to the used color material as long as the material can be color-erased when heated to a high temperature and can be recolored by cooling. Leuco dye is generally used as a well-known color material, and such a constitution is selected in which the color developing agent, color erasing agent, discoloration temperature adjusting agent and the like are properly combined, and the color generation is eliminated at a temperature above a certain temperature and recolored at a temperature below a certain temperature.

Figure 2:
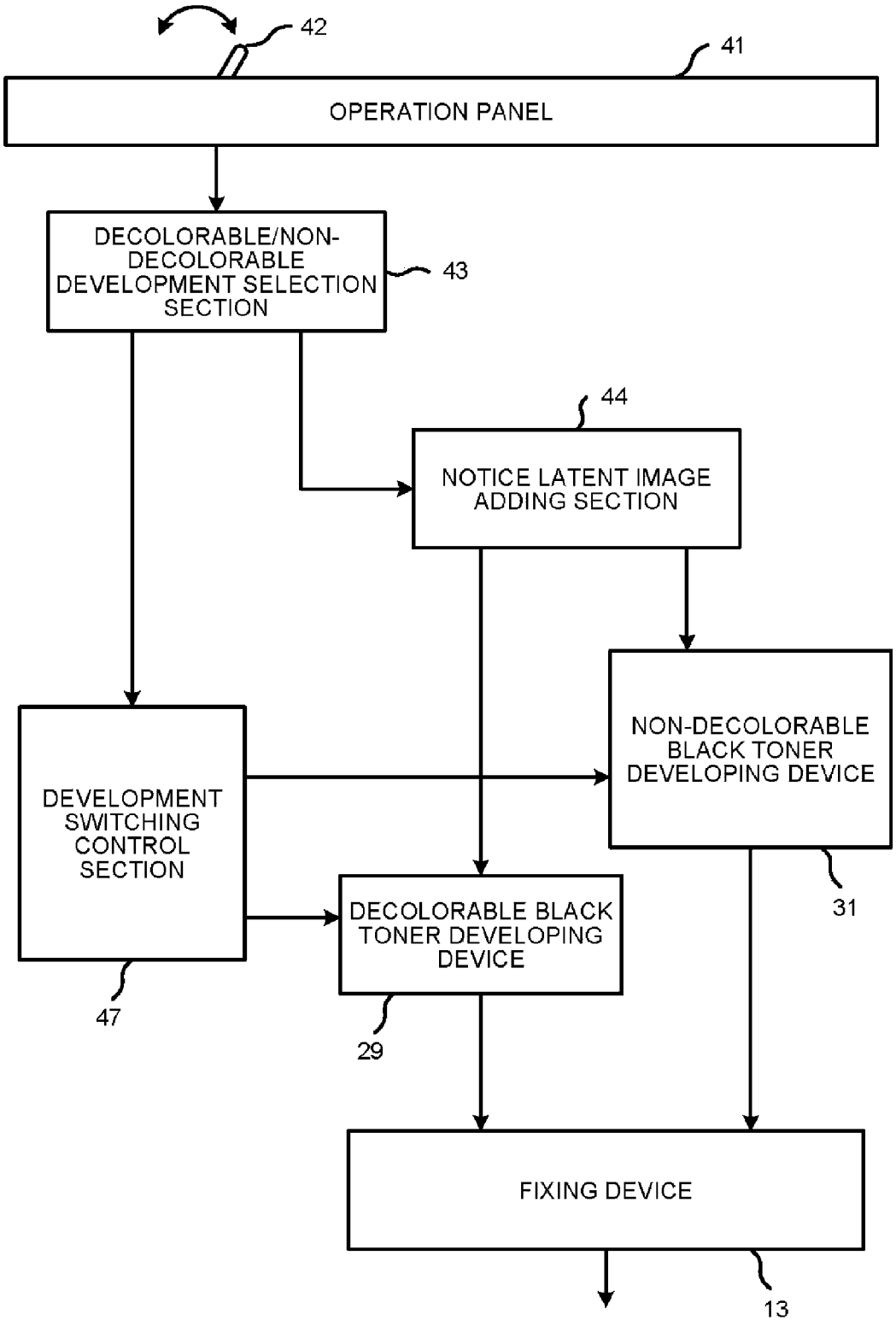
FIG. 2 is a block diagram illustrating an example of the constitution of a developing and fixing device of the image forming apparatus according to the embodiment shown in FIG. 1.

An example of the electronic constitution mainly about the image formation of the MET 1 is shown in FIG. 2. The example of the constitution shown in FIG. 2 comprises an operation panel 41 as an operation section of the MFP 1, an decolorable/non-decolorable switching section 42 arranged on the operation panel 41, an decolorable/non-decolorable development selection section 43 for selecting development based on decolorable toner/non-decolorable toner corresponding to the switching operation of the switching section, a notice latent image adding section 44 for forming a latent image of a notice indicating decolorable/non-decolorable toner on the photoconductive drum 21*d*, the decolorable black toner developing device 29 for developing the latent image of the notice and the latent image of original information with decolorable black toner EBK, the non-decolorable toner developing device 31 for developing the latent image of the notice and the latent image of original information with non-decolorable black toner NBK, a development switching control section 47 for carrying out a switching operation to select to develop an image with decolorable toner or non-decolorable toner according to the control of the decolorable/non-decolorable development selection section 43, and a fixing device 13 for fixing an image developed by the decolorable black toner developing device 29 or the non-decolorable black toner developing device 31.

The operation panel 41 is provided with various input keys and a liquid crystal panel for carrying out various display. The input keys include a start key and a numeric keypad.

The MFP 1 can select either of a mode (decolorable toner monochrome mode) for forming an image with decolorable black toner only and a mode (non-decolorable toner monochrome mode or non-decolorable toner color mode) for forming a monochrome image or a color image with non-decolorable toner only to form an image. The switching between these modes is carried out by a user through the decolorable/non-decolorable switching section 42 on the operation panel 41.

In a case of the decolorable toner monochrome mode, development is carried out with decolorable black toner using the decolorable black toner developing device 29.

In a case of forming an image with the non-decolorable toner only, the non-decolorable black toner developing device 31, the yellow image forming section 7*a*, the magenta image forming section 7*b* and the cyan image forming section 7*c* are used to form a monochrome image or a color image of 2~4 colors selected form these colors.

Further, in a case of the black toner monochrome mode within the decolorable toner monochrome mode and the non-decolorable toner monochrome mode, the black image forming section 9 is operated, and the image forming sections 7*a*-7*c* are not operated. In the decolorable toner monochrome mode and the black toner monochrome mode, the intermediate transfer belt 6 is moved by a moving mechanism (not shown), and is contacted with the photoconductive drum 21*d* only. In this way, it is prevented that the image forming sections 7*a*~7*c* are driven unnecessarily, which can prevent the abrasion of the photoconductive drums 21*a*-21*c* and the intermediate transfer belt 6 and the like.

As stated above, in the black image forming section 9, an image is developed selectively with decolorable or non-decolorable black toner on the photoconductive drum 21*d*. Thus, the apparatus can be downsized compared with a case where a dedicated photoconductive drum for decolorable toner is arranged. Further, in a case of the decolorable black toner monochrome mode or the non-decolorable black toner monochrome mode, only the black image forming section 9 is operated, on the other hand, in a case of the non-decolorable toner color mode, the image forming sections 7*a*~7*c* and the black image forming section 9 are operated, and by carrying out such a switching operation, an image corresponding to various modes can be formed.

Figure 3:
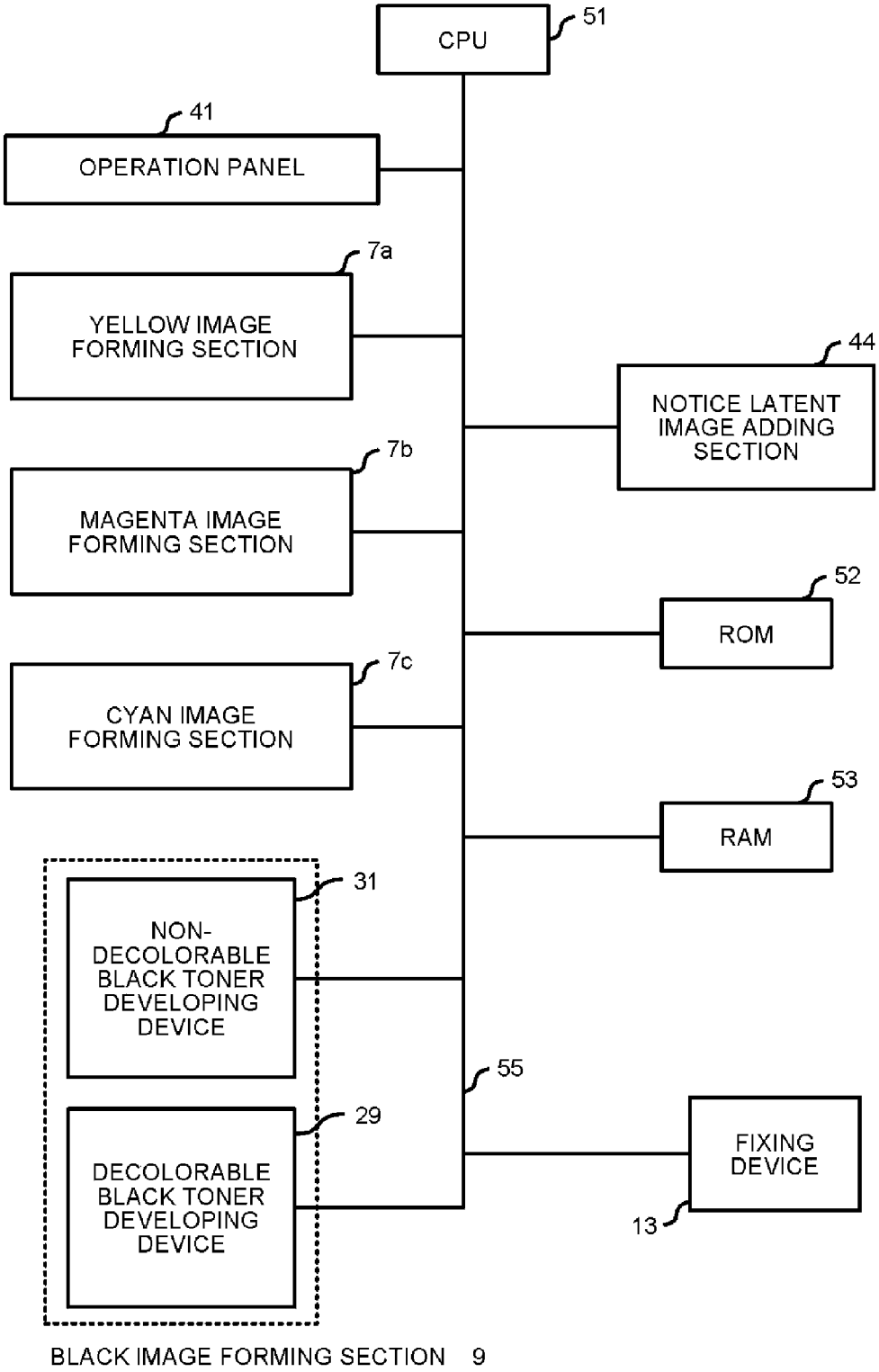
FIG. 3 is a block diagram illustrating an example of the constitution of a control system of the image forming apparatus according to the embodiment shown in FIG. 1.

The main constitution of the control system of the MFP 1 according to the present embodiment is shown in FIG. 3.

The MFP 1 comprises the aforementioned yellow image forming section 7*a*, the magenta image forming section 7*b*, the cyan image forming section 7*c*, the black image forming section 9, the fixing device 13, the operation panel 41 and the notice latent image adding section 44. The MFP 1 further comprises a CPU 51 serving as a control section, a ROM 52, a RAM 53. The CPU 51 is connected with each section through a system bus line 55.

The CPU 51 selects, according to the image forming mode designated from the operation panel 41, an image forming section which is supposed to operate from the yellow image forming section 7*a*, the magenta image forming section 7*b*, the cyan image forming section 7*c* and the black image forming section 9, and determines which one of the decolorable black toner developing device 29 and the non-decolorable black toner developing device 31 in the black image forming section 9 is supposed to operate.

The CPU 51 controls each section connected therewith through the system bus line. The ROM 52 stores various control programs required for the MFP 1 to operate. Each program is executed by the CPU 51. The RAM 53 is a memory for temporarily storing data generated during the execution process of each program.

In the present embodiment, in a case of forming an image using the decolorable black toner developing device 29, in the exposure process based on the notice latent image adding section 44, a latent image is formed by the exposure device 25*d* on the photoconductive drum 21*d* as an additional latent image before the image is developed by the decolorable black toner developing device 29.

The notice can be added by pre-storing, under the control of the CPU 51, the notice in the RAM 53 as a character generator, and then superposing and exposing pattern images based on the character generator on the photoconductive drum 21*d* in a case of forming an image with decolorable black toner. Further, it is also applicable that the characters of the notice are directly added as a latent image without using light.

Figure 4:
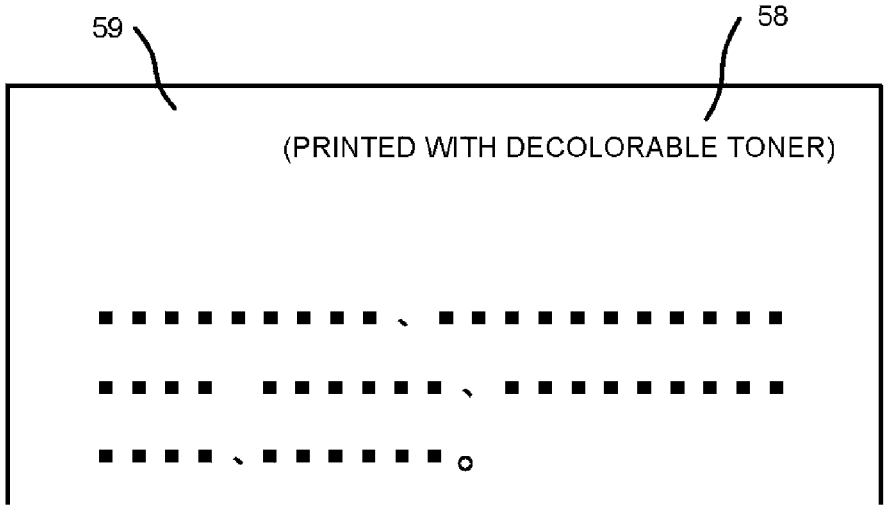
FIG. 4 is a diagram illustrating a printing example of a notice in the first embodiment.

Thus, in a case of forming an image on a sheet with the decolorable black toner to achieve a printing object, the notice is recorded on the printing object and then output. An example of the printing of the notice is shown in FIG. 4.

In this example, as shown by a number 58, a notice of "printed with decolorable toner" is printed at the upper right of the printed paper 59. This is a printing object which is subjected to a developing processing by the decolorable black toner developing device 29 and a fixing processing by the fixing device 13 and then output, and before the original image on the printing object is developed and fixed, a selective exposure is carried out to form a latent image in the exposure device 25.

Figure 5:
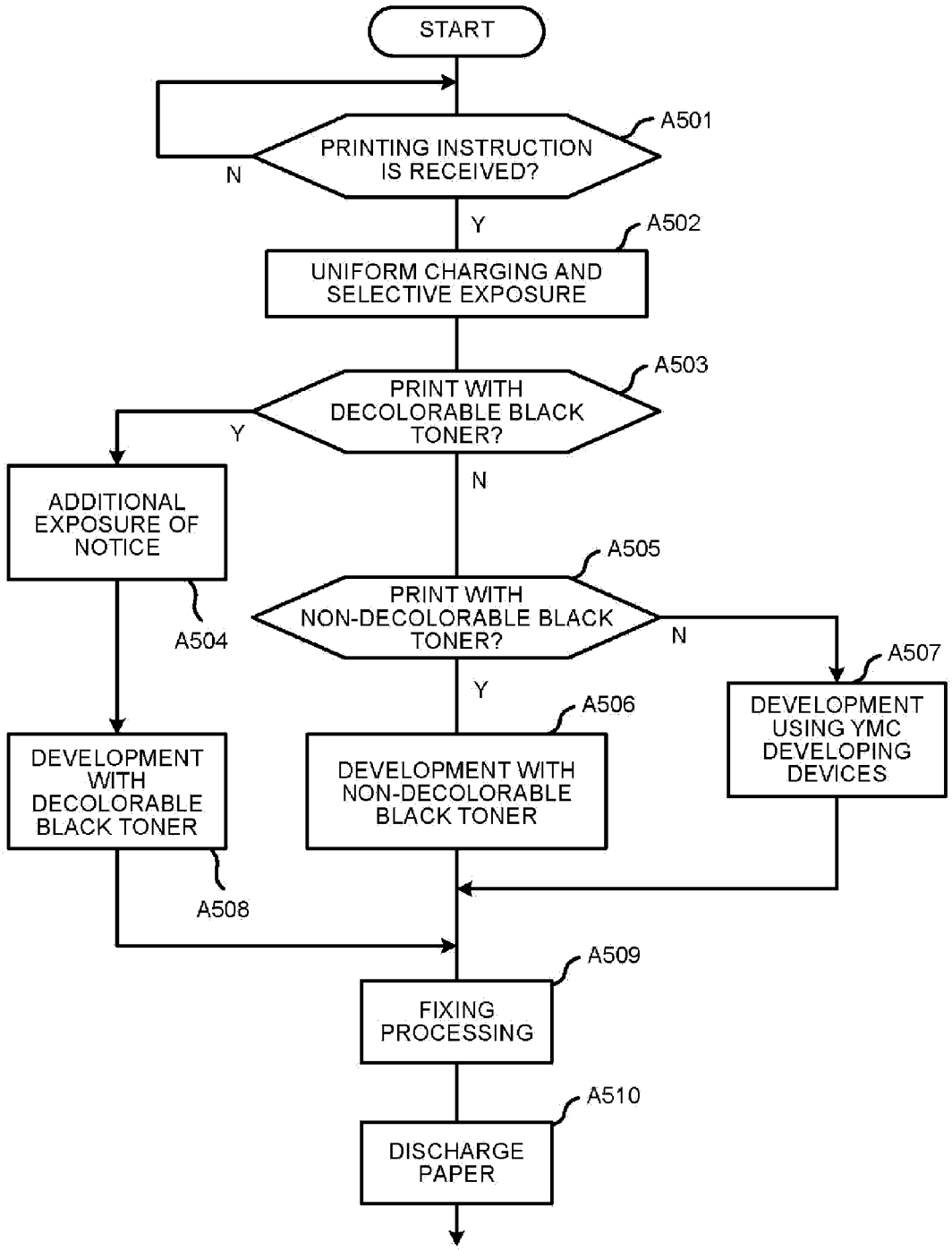
FIG. 5 is a flowchart illustrating operations carried out in the first embodiment.

The operations of the present embodiment are described according to the flowchart shown in FIG. 5. If a printing instruction is received in ACT A501, the uniform charging and selective exposure are carried out in ACT A502. If it is instructed to carry out printing with decolorable black toner in ACT A503, the additional exposure of the notice is carried out by the notice latent image adding section 44 in ACT A504.

On the other hand, if it is not printing with the decolorable black toner in ACT A503 (NO in ACT A503), it is checked whether or not it is printing with non-decolorable black toner in ACT A505. If it is printing with non-decolorable black toner (YES in ACT A505), the developing processing is carried out with the non-decolorable black toner in the non-decolorable black toner developing device 31. Further, if it is not printing with the non-decolorable black toner in ACT A505 (NO in ACT A505), then it is non-decolorable color printing, therefore, the flow proceeds to ACT A507 to carry out color developing processing using the YMC developing devices (developing devices 27*a*, 27*b* and 27*c*). In this case, the non-decolorable black toner developing device 31 may also be used in combination.

On the other hand, in a case of printing with the decolorable black toner, the additional exposure of the notice is carried out in ACT A504, and then the developing processing is carried out by the decolorable black toner developing device 29 in ACT A508.

After the developing processing is carried out in ACTs A506, A507 and A508, the paper is conveyed to the fixing device 13 to be subjected to a toner image fixing processing in ACT A509. The paper on which the toner image is fixed is discharged from the MFP 1 in ACT A510.

In the embodiment described above, it is exemplified that the notice is added to create a synthetic latent image, and the printing of the notice and the printing of the image information is carried out in one single developing processing. In this way, the image formation of the notice and the image formation of the image information can be carried out in one single developing process, which can shorten the time taken for the image forming processing.

Figure 6:
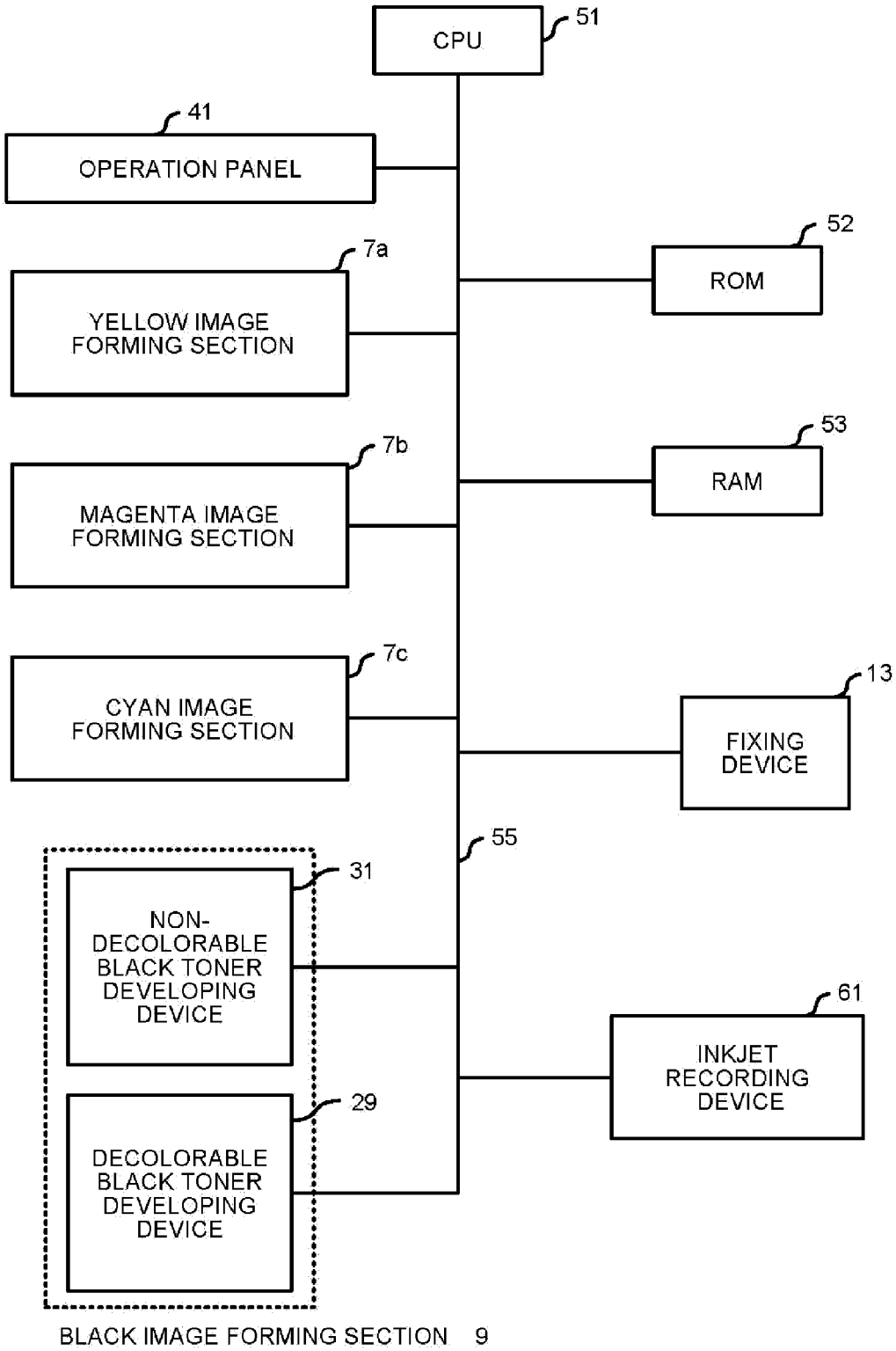
FIG. 6 is a block diagram illustrating an example of the constitution of a control system of an image forming apparatus according to a second embodiment.

However, the printing of the notice may be carried out before or after the printing of the image information. For example, it is also possible to add and record the notice using an inkjet recording device on the paper after the image is formed and fixed on the paper. A diagram of the main constitution in this case is shown in FIG. 6.

In the second embodiment, an inkjet recording device 61 is arranged instead of the notice latent image adding section 44 shown in FIG. 3. The other parts of the constitution shown in FIG. 6 are the same with the constitution shown in FIG. 3, and are endowed with the same number and reference mark.

Figure 7:
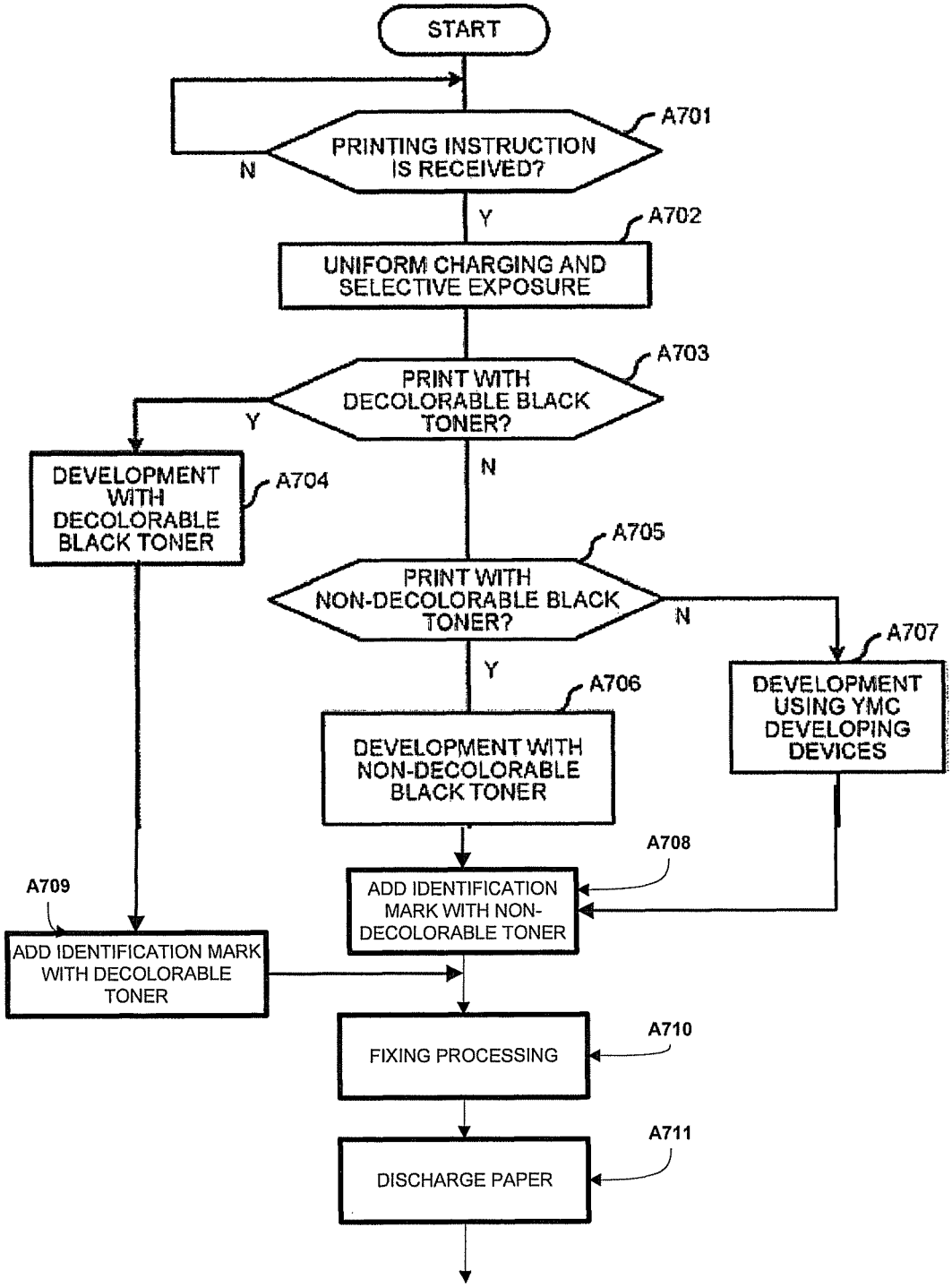
FIG. 7 is a flowchart illustrating operations carried out in the second embodiment.

The operations carried out in the second embodiment are described according to the flowchart shown in FIG. 7.

First, if a printing instruction is received in ACT A701, the uniform charging and selective exposure are carried out in ACT A702. It is checked whether or not it is printing with the decolorable black toner in ACT A703. If it is printing with the decolorable black toner (YES in ACT A703), the developing processing is carried out by the decolorable black toner developing device 29 in ACT A704.

On the other hand, if it is not printing with the decolorable black toner in ACT A703 (NO in ACT A703), then it is printing with the non-decolorable toner, thus, it is checked whether or not it is printing with the non-decolorable black toner in ACT A705. If it is printing with the non-decolorable black toner in ACT A705 (YES in ACT A705), the developing processing is carried out by the non-decolorable black toner developing device 31 in ACT A706. Further, if it is not printing with the non-decolorable black toner in ACT A705 (NO in ACT A705), then it is non-decolorable color printing, therefore, color printing is carried out by the developing devices 27*a*, 27*b* and 27*c* in ACT A707. In this case, the non-decolorable black toner developing device 31 may also be used in combination.

If it is printing with the decolorable black toner, a notice indicating that the printing may be carried out with decolorable toner is recorded by the inkjet recording device on the paper on which the toner image is fixed. Further, an identification mark instead of the notice (words) may be added using uniform recording material. In a case where the development is carried out with non-decolorable toner, the identification mark is added with non-decolorable toner in ACT A708. In a case where the development is carried out with decolorable toner, the identification mark is added with decolorable toner in ACT A709. In this way, the toner image on the paper subjected to developing processing is fixed by the fixing device 13 in ACT A710. Then the paper is discharged from the MFP 1 in ACT A711.

According to the second embodiment, a notice relating to the toner can be recorded by arranging the inkjet recording device at the downstream side of the fixing device without changing the structure of the MFP.

Generally, if the notice is printed by an inkjet type device as stated in the second embodiment, the notice is not decolorable inmost cases; therefore, it is preferred to print the notice in a case of printing with non-decolorable toner.

In the embodiments described herein, only in a case of printing with the decolorable black toner, is a notice indicating a message of "printed with decolorable toner" printed at the upper right of the paper. However, the printing position of the notice is not limited, and the notice may be printed at a position different from the upper right position, for example, the lower left/right of the paper.

On the contrary, the notice may be printed only in a case of printing with the non-decolorable black toner. Alternatively, the notice may be printed both in a case of printing with non-decolorable black toner and in a case of printing with decolorable black toner.

Moreover, in the embodiments described above, in a case of printing with non-decolorable toner, the black toner and the color toner are used to print, and in a case of printing with decolorable toner, only the black toner is used to print. However, the present invention is not limited to this, and in a case of printing with decolorable toner, not only the black toner but also the non-decolorable color toner can be used to print. Besides, the development based on the decolorable and non-decolorable toner is not limited to black color, and the present invention may also be applied to a case of a development based on other uniform color.

The toner image is transferred once and fixed in the embodiments described above, however, it is also applicable to form the toner image on the paper directly.

In the embodiments stated above, during the latent image forming process, the additional latent image is formed and developed; alternatively, the notice is recorded in an inkjet manner after the image forming processing is carried out. However, the present invention is not limited to this, and the notice may be visually recorded on the paper during the image forming process, or after the image forming process but before the paper is output.

Further, a mark instead of the notice (words) may be printed to indicate that the printing is carried out with non-decolorable toner or decolorable toner, and generally, a visible identification mark is printed to indicate that the development is carried out with non-decolorable toner or decolorable toner. Further, in a case where the development is carried out with decolorable toner, it is preferred that the identification mark is also developed with decolorable toner.

In the embodiments described above, it is exemplified that the color of the non-decolorable toner and the decolorable toner is uniform black color. However, it is not necessarily to be the uniform black color, it may be any color of the same system. Further, the visible identification mark may also be added using uniform recording material as well as the color of the same system.

It is exemplified in the embodiments described above that the development is carried out with toner. However, the present invention may also be applied to a case where recording is carried out in an inkjet manner, and the development is not limited to toner, generally, the present invention may be applied to a case of printing (general visualization is included herein) with recording material.

In accordance with the embodiments stated above, there is provided an image forming apparatus which can easily identify whether the printing is carried out with non-decolorable recording material or decolorable recording material.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

first printing device configured to carry out printing with a non-decolorable recording material;

second printing device configured to carry out printing with a decolorable recording material, the color of which is same or same color system of the color of the non-decolorable recording material; and an identification mark adding section configured to add an identification mark, to a record receiving member printed by at least one of the first printing device and the second printing device, the identification mark being the same recording material corresponding to the first printing device or the second printing devices which is used to print the record receiving materials.

2. The image forming apparatus according to claim 1, wherein the identification mark is added to the record receiving member using non-decolorable recording material if the printing is carried out by the first printing device.

3. The image forming apparatus according to claim 2, wherein the color of the decolorable recording material and the color of the non-decolorable recording material are colors of the black color system.

4. The image forming apparatus according to claim 3, wherein the identification mark is words indicating that the printing is carried out with decolorable recording material or non-decolorable recording material.

5. The image forming apparatus according to claim 1, wherein the identification mark is only recorded on a record receiving member printed with decolorable recording material.

6. The image forming apparatus according to claim 1, wherein the identification mark is added to the record receiving member in an inkjet manner after a latent image formed through selective exposure is developed.

7. An image forming apparatus, comprising:

a non-decolorable black toner developing device configured to carry out developing processing with non-decolorable black toner;

a decolorable black toner developing device configured to carry out developing processing with decolorable toner of a color of the same system with the non-decolorable black toner;

a non-decolorable yellow developing device configured to carry out developing processing with non-decolorable yellow toner;

a non-decolorable magenta developing device configured to carry out developing processing with non-decolorable magenta toner;

a non-decolorable cyan developing device configured to carry out developing processing with non-decolorable cyan toner; and an identification mark adding section configured to add, if it is instructed to carry out developing processing using the decolorable black toner developing device, a visible identification mark indicating that the development is carried out with the decolorable black toner to a record receiving member subjected to the developing processing by the decolorable black toner developing device, the visible identification mark being the decolorable black toner.

8. The image forming apparatus according to claim 7, wherein the identification mark is added to the record receiving member using the decolorable black toner.

9. The image forming apparatus according to claim 8, wherein the identification mark is developed together with other latent images using the decolorable black toner in a case where the development is carried out by the decolorable black toner developing device.

10. An image forming method, including:

forming on a first record receiving member with non-decolorable recording material;

forming on a second record receiving member with decolorable recording material;

adding a visible identification mark indicating which one of the non-decolorable recoring material and decolorable recording material is used for printing, the visible identification mark being added with the same recording material corresponding to the first record receiving member or second record receiving member with the recording material used for the printing thereof.

* * * * *

UNITED STATES PATENT AND TRADEMARK OFFICE

CERTIFICATE OF CORRECTION

PATENT NO. : 9,213,286 B1
APPLICATION NO. : 14/319500
DATED : December 15, 2015
INVENTOR(S) : Masato Ogasawara It is certified that error appears in the above-identified patent and that said Letters Patent is hereby corrected as shown below:

On the Title Page item (73) Assignees:

Kabushiki Kaisha Toshiba, Tokyo (JP);
Toshiba Tec Kabushiki Kiasha, Tokyo (JP)

It should read:

(73) Assignees:

Kabushiki Kaisha Toshiba, Tokyo (JP);
Toshiba Tec Kabushiki Kaisha, Tokyo (JP)

Signed and Sealed this
Twelfth Day of April, 2016

Michelle K. Lee

Michelle K. Lee
*Director of the United States Patent and Trademark Office*